US008387752B2

(12) United States Patent
Lagerstedt

(10) Patent No.: US 8,387,752 B2
(45) Date of Patent: Mar. 5, 2013

(54) REPLACEABLE UTILITY POLE ANCHOR SYSTEM

(76) Inventor: Paul Lagerstedt, Duvall, WA (US)

( * ) Notice: Subject to any disclaimer, the term of this patent is extended or adjusted under 35 U.S.C. 154(b) by 125 days.

(21) Appl. No.: 12/813,434

(22) Filed: Jun. 10, 2010

(65) Prior Publication Data

US 2010/0314197 A1 Dec. 16, 2010

Related U.S. Application Data

(60) Provisional application No. 61/185,606, filed on Jun. 10, 2009.

(51) Int. Cl.
*A62B 35/00* (2006.01)

(52) U.S. Cl. ..... 182/87; 182/90

(58) Field of Classification Search ..... 182/87, 182/90

See application file for complete search history.

(56) References Cited

U.S. PATENT DOCUMENTS

| | | | | | |
|---|---|---|---|---|---|
| 488,274 | A | | 12/1892 | Gray | |
| 1,427,030 | A | * | 8/1922 | Stephens et al. | 482/75 |
| 2,703,688 | A | * | 3/1955 | Shuter | 248/72 |
| 2,706,023 | A | | 4/1955 | Merritt | |
| 2,957,538 | A | * | 10/1960 | Pottmeyer et al. | 182/90 |
| 3,022,855 | A | * | 2/1962 | Lewis | 182/3 |
| 3,042,353 | A | | 7/1962 | O'Mara | |
| 3,294,196 | A | * | 12/1966 | Rabelos | 182/100 |
| 3,297,293 | A | * | 1/1967 | Andrews et al. | 248/499 |
| 3,538,237 | A | | 11/1970 | Hockaway | |
| 3,568,968 | A | | 3/1971 | Taylor | |
| 3,884,442 | A | | 5/1975 | Breeden et al. | |
| 4,048,779 | A | | 9/1977 | Valenziano et al. | |
| 5,174,535 | A | | 12/1992 | Stubbersfield | |
| 5,271,481 | A | * | 12/1993 | Rich | 182/3 |
| 5,346,036 | A | * | 9/1994 | Arisman et al. | 182/3 |
| 5,361,866 | A | * | 11/1994 | Bell et al. | 182/3 |
| 5,544,717 | A | * | 8/1996 | White et al. | 182/90 |
| 5,687,535 | A | * | 11/1997 | Rohlf | 52/713 |
| 5,850,889 | A | * | 12/1998 | Rexroad et al. | 182/3 |
| 5,887,677 | A | * | 3/1999 | Malmgren | 182/92 |
| 6,009,973 | A | | 1/2000 | Woodyard | |
| 6,142,434 | A | | 11/2000 | Trost | |
| 6,298,629 | B1 | * | 10/2001 | Ador | 52/698 |
| 6,378,822 | B1 | * | 4/2002 | Franks | 248/218.4 |
| 6,382,356 | B1 | | 5/2002 | Skinner et al. | |
| 6,595,477 | B2 | * | 7/2003 | Roberts | 248/219.3 |
| 6,612,631 | B1 | * | 9/2003 | Pearl | 294/215 |
| 6,779,316 | B2 | * | 8/2004 | Carroll | 52/698 |
| 6,786,020 | B2 | * | 9/2004 | Poldmaa | 52/704 |
| 6,802,390 | B2 | * | 10/2004 | Peterson et al. | 182/36 |
| 6,868,647 | B2 | * | 3/2005 | Poldmaa | 52/749.12 |
| 7,111,812 | B2 | | 9/2006 | Shannon et al. | |
| 7,992,679 | B2 | * | 8/2011 | Geens et al. | 182/3 |
| 2002/0079164 | A1 | * | 6/2002 | Choate | 182/36 |
| 2007/0017740 | A1 | * | 1/2007 | Geens et al. | 182/3 |

* cited by examiner

*Primary Examiner* — Alvin Chin Shue
*Assistant Examiner* — Colleen M Chavchavadze
(74) *Attorney, Agent, or Firm* — Dean A. Craine

(57) ABSTRACT

An anchor system for a utility pole that temporarily prevents falls by a utility worker. The system has a bolt and a head formed on one end and a threaded shank that extends through a utility pole and exposed on one surface of the pole. A concave saddle washer is attached to the bolt that rests against the pole's outer curved surface. A concave saddle plate located on the end of the bolt opposite the saddle washer rests against the opposite surface of the pole. An optional nylon sleeve is disposed between the ring member and the hinge plate to reduce sounds and interference. In one embodiment, the ring member freely pivots on the hinge plate. In another embodiment, the ring member is held in a diagonal position of the hinge plate until a free-fall force is exerted thereto that causes the ring member to move to a longitudinal position.

7 Claims, 8 Drawing Sheets

REPLACEABLE UTILITY POLE ANCHOR SYSTEM

This utility patent application is based on and claims the benefit of U.S. Provisional patent application (Ser. No. 61/185,606), filed on Jun. 10, 2009.

BACKGROUND OF THE INVENTION

1. Field of the Invention

This invention relates to fall prevention devices, and more/particularly to anti-fall devices used with utility poles.

2. Description of the Related Art

Utility companies employ utility linemen to climb utility poles, replace, and install new wires and electronic components on wood utility poles. Many older utility poles have foot pegs that are imbedded into the sides of the pole that lineman use to grasp and stand on when climbing. When the foot pegs are not present, the lineman must use ladders or special climbing boots with spikes and a waist strap to climb the pole. Once the desired height is reached, the linemen need to "tie off" onto other structures on the pole to prevent falls to the ground. Unfortunately, many new and older utility poles do not include structures that lineman can 'tie to' at the desired height.

Metal structures attached to utility poles that clang against other metal surfaces or structures can be annoying to nearby residences. Also, when metal structures on a utility pole impact, radio interference "noise" may be generated on nearby computers, modems and telephones.

Federal and state regulations require that fall prevention devices used on utility poles be replaced when used once to prevent a 'free-fall'.

SUMMARY OF THE INVENTION

It is an object of the present invention to provide a utility pole anchor system that can be used with old and new wood utility poles that a lineman may 'tie to' to prevent falls.

It is another object of the present invention to provide such an anchor system that can be used in place of existing foot pegs on a wood utility pole.

It is another object of the present invention to provide another system that does not clang or produce radio interference at nearby residences.

It is a further object to provide such another system that can visually indicate whether it has been used to prevent a 'free-fall' and should be replaced.

These and other objects are met by the anchor system for a utility pole disclosed therein that includes an elongated bolt and a head formed on one end and a threaded shank that has a length sufficient to extend through a standard utility pole. Attached to one end of the bolt is an optional wide concave saddle plate designed to fit close against the outer curved surface of a utility pole. Attached to the other end of the bolt is an optional concave saddle washer also designed to fit against the outer curved surface of the utility pole opposite the saddle plate. Attached to the bolt and outside the saddle plate is a hinge plate with a flat upper body with a bolt hole formed therein. Formed on one end of the hinge plate is a hinge pin passageway that is perpendicularly aligned with the hinge pin's longitudinal axis. During use, the hinge plate is designed to be adjustably rotated over the bolt so that when the hinge pin passageway is located below the bolt, a nut may be attached and tightened on the exposed end of the bolt to lock the hinge plate in a desired position. In one embodiment, the saddle plate is eliminated and the upper body of the hinge plate is concave and designed to fit directly against the utility pole.

Located below the hinge plate is a ring member with a lower center hole, an upper slot, and a transversely aligned upper leg. During assembly, the upper leg is longitudinally aligned and disposed inside the hinge pin passageway formed on the hinge plate to rotably connect the ring member to the hinge plate. The upper slot is located below and adjacent to the leg so that the ring member may swing outward from the pole when a D-ring clip, a snap hook, or carabineer is attached to the lineman's safety strap is attached to it. Once the hinge plate is rotated to its desired position, the nut attached to the threaded shank is then manually tightened to force the saddle plate and saddle washer inward against the opposite sides of the utility pole to hold the system in place.

In one embodiment, a nylon sleeve is placed inside the hinge plate passageway and and around the upper leg to prevent direct contact of the upper leg with the hinge plate.

In another embodiment, a ring plate is held on the utility pole in a downward, diagonal fixed position relative to the hinge plate by one or more spot welds. When a 'free-fall' force is exerted or the ring member during use, the ring plate is forcibly rotated downward which breaks the spot welds. The ring member then remains in a longitudinally aligned position relative to the hinge plate thereby informing a viewer that anchor has been exposed to a free fall force.

DESCRIPTION OF THE PREFERRED EMBODIMENT(S)

Figure 1:
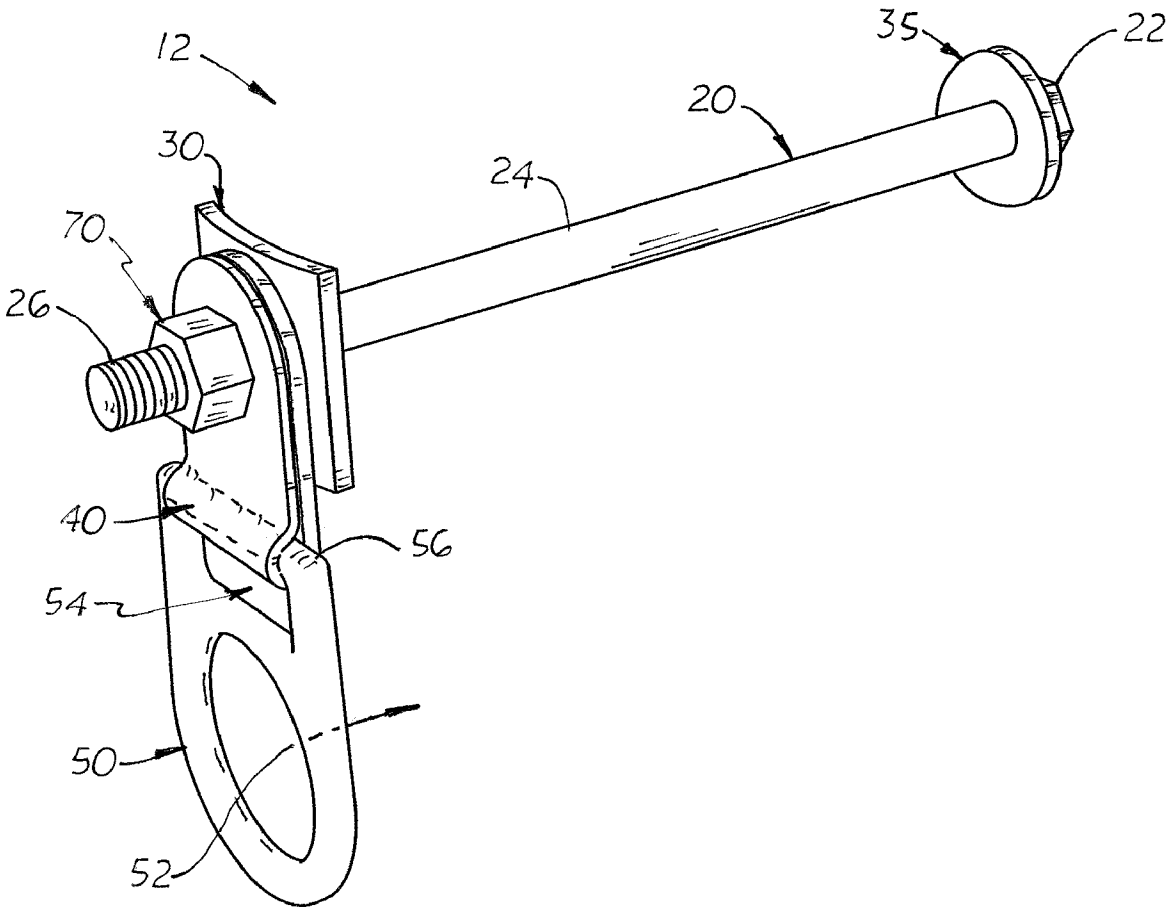
FIG. 1 is a perspective view of the utility pole anchor system.
Figure 2:
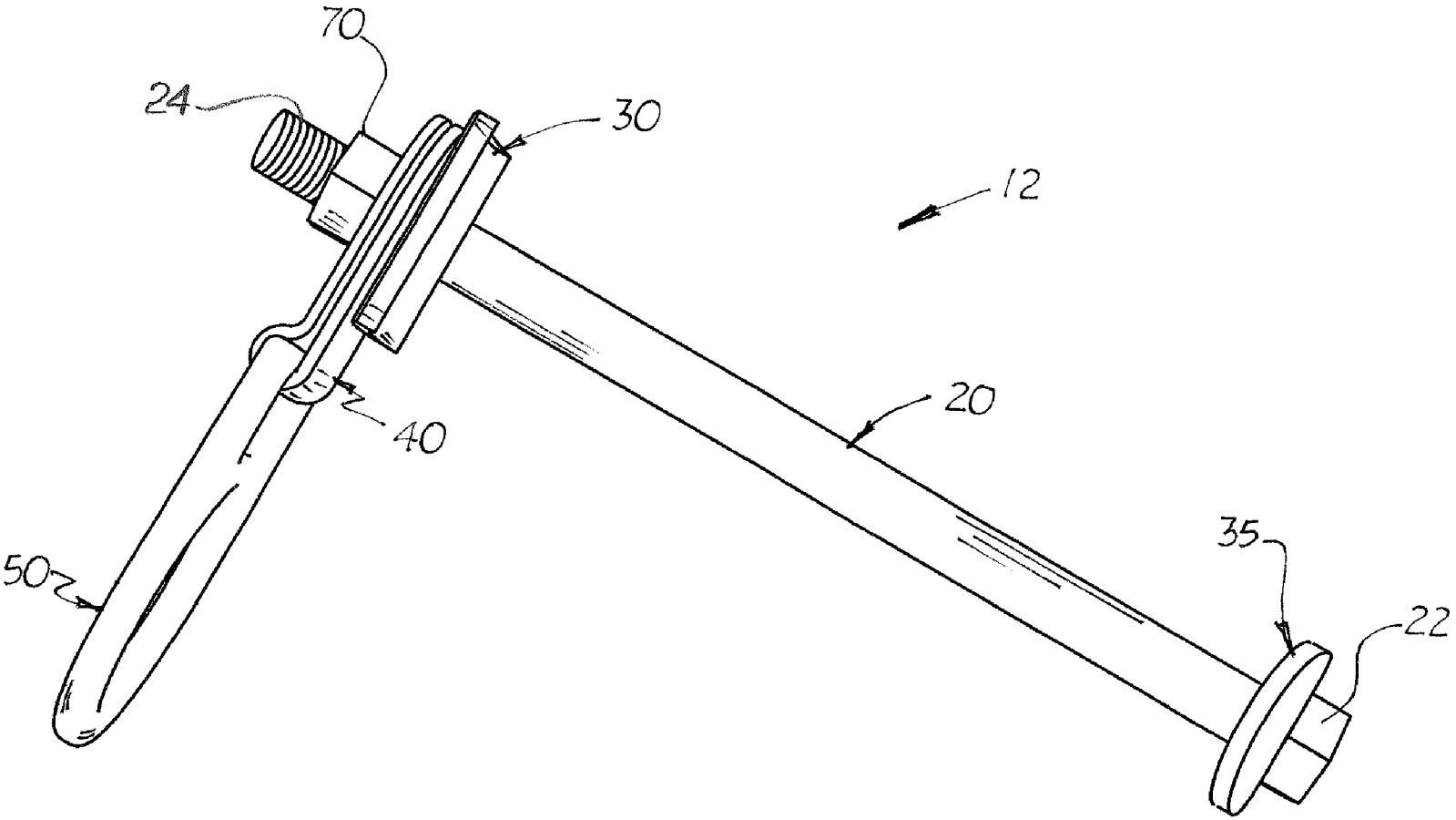
FIG. 2 is a second perspective view of the utility pole anchor system.
Figure 3:
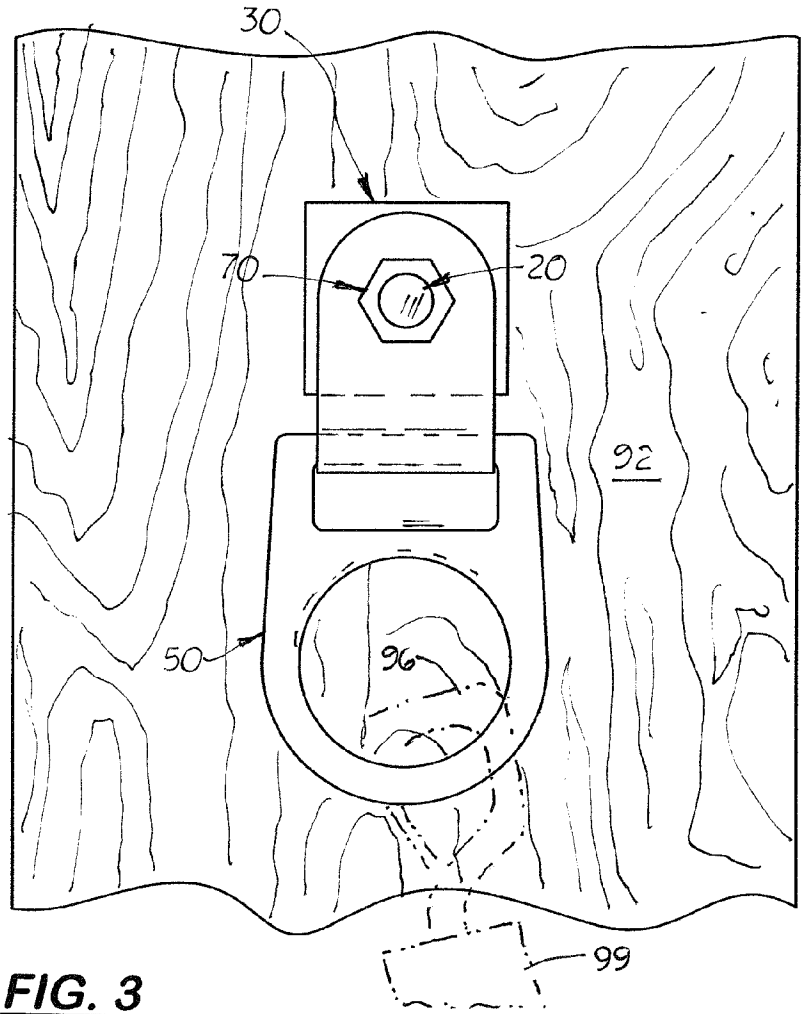
FIG. 3 is a front plan view of the anchor system attached to a utility pole.
Figure 4:
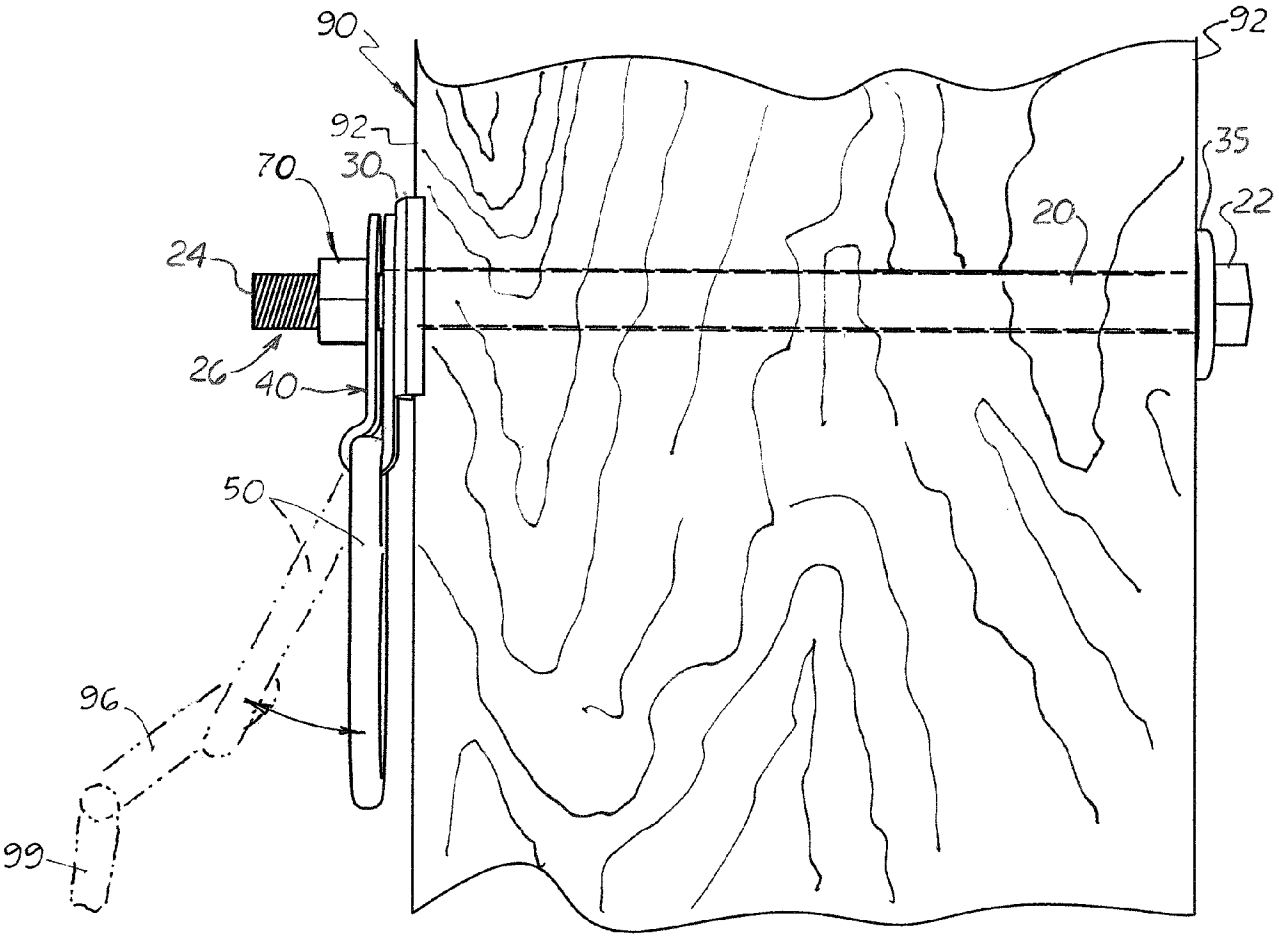
FIG. 4 is a right side elevational view of the anchor system shown in FIG. 3.

Referring to FIGS. 1-14, there is shown and described herein an anchor system, indicated by the reference number 12, 12', 12" for a utility pole 90. The system 12, 12', 12" includes an elongated bolt 20 with a hexagonal head 22 and a shank 24. The end of the shank 24 opposite the head 22 includes external threads 26. The length of the shank 24 is sufficient to extend through a horizontal hole 94 formed on standard 8 to 12 inch diameter utility pole 90.

Attached to one end of the bolt 20 is a wide concave saddle plate 30 designed to fit close against the outer curved surface 92 of a utility pole 90. Attached to the other end of the bolt 20 is a concave saddle washer 35 designed to fit against the opposite outer curved surface 92 of the utility pole 90 opposite the saddle plate 30.

FIGS. 1-5 show the first embodiment of the system 12 that includes a bolt 20 with a separate saddle plate 30 located inside the hinge plate 40. The hinge plate 40 includes a flat upper body 42 with a bolt hole 44 formed therein. Formed on one end of the hinge plate 40 is a hinge pin passageway 46 that is perpendicularly aligned with the hinge plate's longitudinal axis 48. During use, the hinge plate 40 is designed to be adjustably rotated over the bolt 20 so that when the hinge pin passageway 46 is located below the bolt 20. A nut 70 is attached to the threaded end of the bolt 20 which is manually tightened to lock the hinge plate 40 in a desired position over the saddle plate 30 and bolt 20.

Located below the hinge plate 40 is a ring member 50 with a lower center hole 52, an upper slot 54, and an upper transversely aligned leg 56. During assembly, the leg 56 is longitudinally aligned and disposed inside the hinge pin passageway 46 formed on the hinge plate 40 to rotatably connect the ring member 50 to the hinge plate 40. The upper slot 54 is located below and adjacent to the leg 56 is sufficient in size and shape so that the ring member 50 may swing outward from the pole 90 when a D-ring clip 96 attached to the lineman's safety strap 99 is attached to it. Once the hinge plate 40 is rotated to its desired position, the nut 70 attached to the external threads 26 on the shank 24 is then tightened to force the saddle plate 30 and saddle washer 35 inward against the opposite sides 92 of the utility pole 90.

Figure 6:
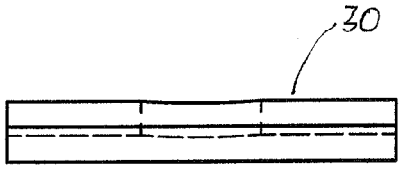
FIG. 6 is a top plan view of the saddle plate.
Figure 7:
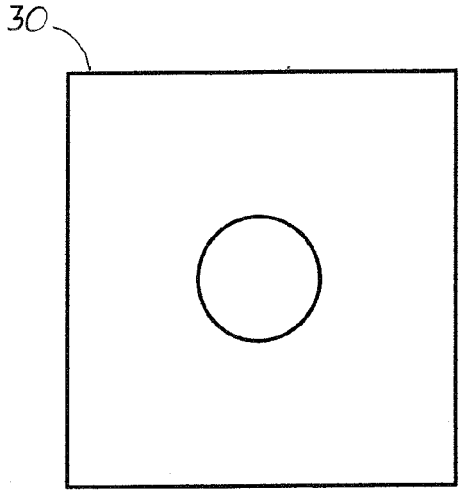
FIG. 7 is a front plan view of the saddle plate.
Figure 8:
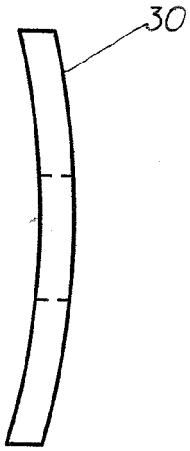
FIG. 8 is a right side view of the saddle plate.

FIGS. 6-8 are top, front, side elevational views of the saddle plate 30.

Figure 9:
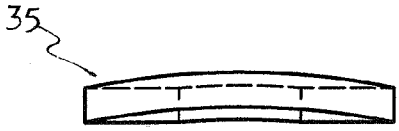
FIG. 9 is a top plan view of the saddle washer.
Figure 10:
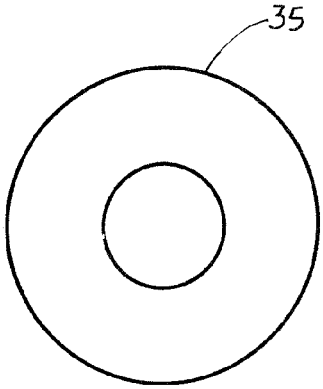
FIG. 10 is a front plan view of the saddle washer.

FIGS. 9 and 10 are top and plan views of the saddle washer 35.

In the preferred embodiment, the bolt 20, the saddle plate 30, the saddle washer 35, the hinge plate 40 and the ring member 50 are made of galvanized steel.

Figure 11:
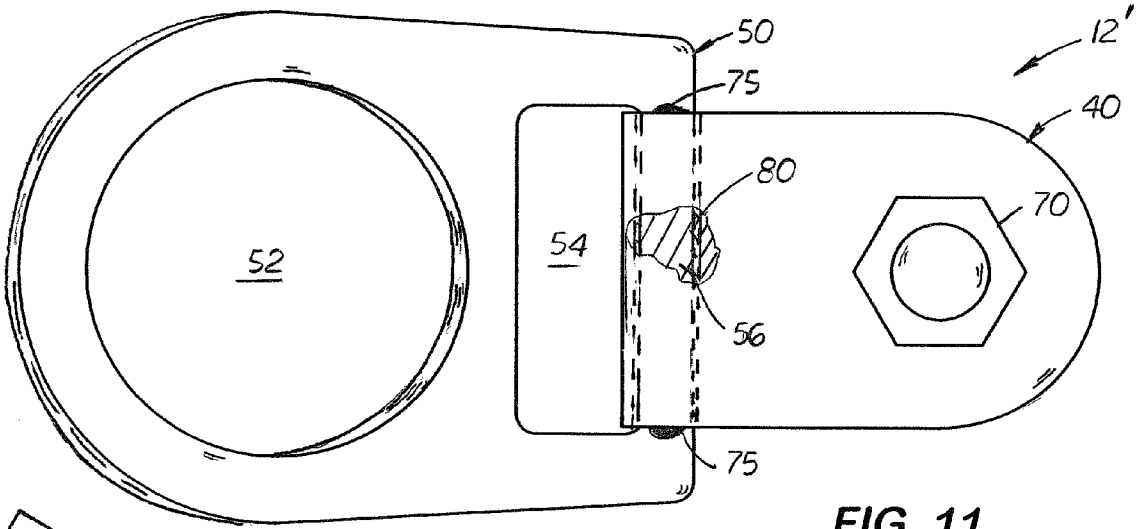
FIG. 11 is a top plan view of the anchor with the ring plate diagonally aligned on the hinge plate with at least one spot weld located between the ring plate and the hinge plate and a nylon sleeved located in the hinge plate passageway.
Figure 12:
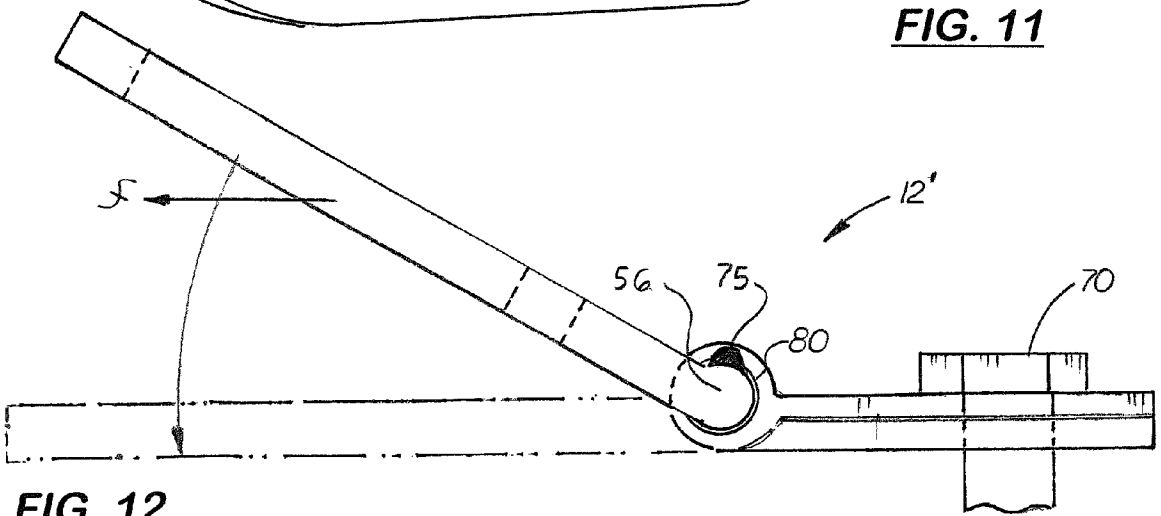
FIG. 12 is a side elevational view of the anchor shown in FIG. 11.

FIG. 11 is a top plan view of a second embodiment of the anchor system, indicated by the reference number 12', in which the ring member 50 is temporarily fixed in a diagonally alignment with respect to the hinge plate 40 by at least one spot weld 75 (two welds 75 shown) located between the hinge plate 40 and the ring member 50 When a 'free-fall' force 'f' is exerted or the ring member 50 during use, (approximately 900 lbs) the ring member 50 is forcible rotated downward which breaks the spot weld 75. The ring member 50 then remains in a longitudinally aligned position relative to the hinge plate 40 thereby informing a viewer that anchor has been exposed to a free fall force and should be replaced. In the embodiment shown, the ring member 50 is aligned approximately 30 degrees from the hinge plate 40. It should be understood that in other embodiments, the ring member 50 may be aligned 20 to 90 degrees from the hinge plate 40 and still provide a visual signal that a 'free fall' force has been exerted. It should also be understood that alternative elements and methods, such as clips or adhesives may be used to temporarily hold the ring member 50 in a diagonally aligned position on the hinge plate.

Figure 5:
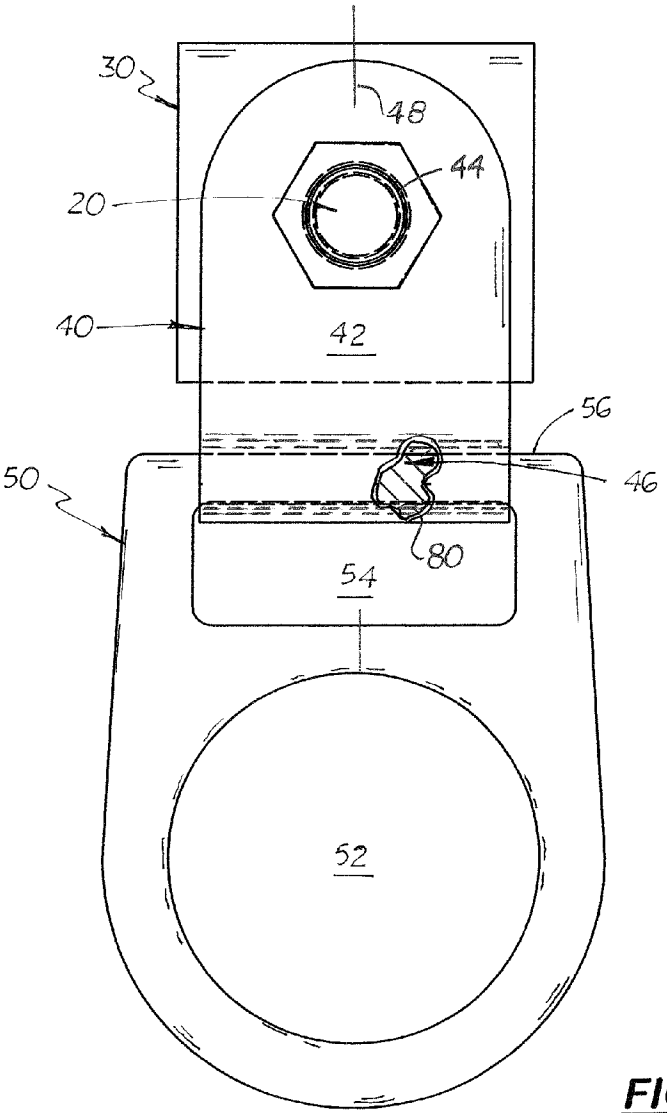
FIG. 5 is a front plan view of the anchor system showing the upper leg on the ring plate inserted into an optional nylon sleeve located in he hinge pin passageway formed on the hinge plate.

Also, shown in FIGS. 5 and 11 is an optional nylon sleeve 80 located inside the hinge plate passageway 46. During manufacturing, the nylon sleeve 80 is placed around the upper leg 56 on the ring member 50. The nylon sleeve 80 and upper leg 56 are then longitudinally aligned and registered inside the hinge plate passageway 46 The nylon sleeve 80 prevents direct contact of the upper leg 56 with the hinge plate 40 thereby reducing clang sounds and electrical interference.

Figures 13, 14:
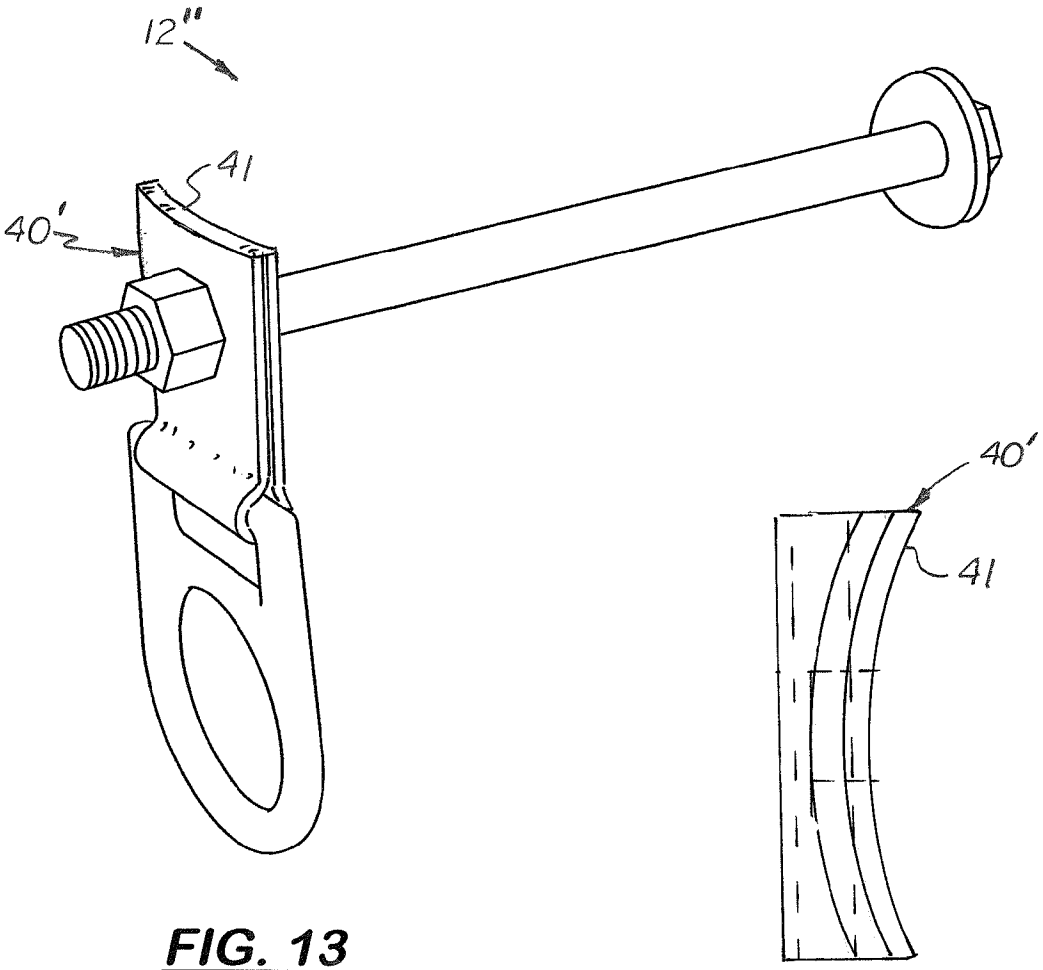
FIG. 13 is a perspective view of a third embodiment of the invention in which the saddle plate is eliminated and the hinge plate is curved to match the outside surface of the pole.
FIG. 14 is a top plan view of the hinge plate used in the third embodiment.

FIG. 13 is a perspective view of a third embodiment of the anchor system, indicated by the reference number 12" in which the saddle plate 30 is eliminated and a modified hinge plate 40' is used that has a curved inside surface 41 designed to mount directly against the curved outside surface of the utility pole 90.

FIG. 14 is a top plan view of the hinge plate 40' used in the third second embodiment.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An anchor system for a utility pole with an outer round circumference and at least one transversely aligned bore formed therein, said anchor system comprises:

a. a single elongated bolt with a head formed on one end and a threaded shank formed on the opposite end, said bolt having a diameter and a length sufficient to extend through the bore formed on the utility pole so that said head and said threaded shank are exposed on opposite sides of the pole;

b. a saddle plate located on the threaded shank of said bolt that extends through the bore, said saddle plate having a concave profile enabling said saddle plate to be placed adjacent to the outer round surface of the utility pole when said bolt is extended through the bore;

c. rotating hinge plate attached to said bolt, said hinge plate includes a transversely aligned hinge pin passageway;

d. a ring member with lower center hole, an upper slot, and an upper transversely aligned upper leg, said upper leg being sufficiently in diameter to fit longitudinally inside said hinge pin passageway formed on said hinge plate, said upper slot transversely aligned on said ring member so that a portion of said rotating hinge plate may extend into said upper slot as said ring member is rotated on said hinge member, said ring member being temporarily affixed in a downward, diagonally aligned position with respect to said hinge plate when said hinge plate is initially attached to a utility pole, and rotates on said hinge plate to a longitudinally aligned position against said utility pole when a free fall force is exerted on said ring member, thereby indicating that a free fall force has been applied to said ring member after said hinge plate has been installed on said utility pole; and e. a nut attached to said threaded shank on said bolt.

2. The anchor system, as recited in claim 1, further including a saddle washer located on said bolt and adjacent to said head, said saddle washer having a concave profile enabling said washer to be placed adjacent to the circumference surface of the utility pole when said bolt is extended through the bore.

3. The anchor system, as recited in claim 1, further including a nylon sleeve located around said upper leg on said ring member and inside said hinge plate passageway.

4. The anchor system, as recited in claim 1, further including at least one spot weld located between said ring member and said hinge plate to temporarily hold said ring member in a downward and diagonally aligned position from said hinge plate.

5. The anchor system, as recited in claim 1, wherein said ring member is downward and diagonally aligned at 30 degrees from said hinge plate.

6. The anchor system, as recited in claim 4, wherein said spot weld breaks when approximately 900 lbs of downward force is exerted on said ring member.

7. The anchor system, as recited in claim 1, further including a nylon sleeve located around said upper leg on said ring member and inside said hinge plate passageway to prevent direct contact between said ring member and said hinge plate.

* * * * *